US009717940B1

(12) United States Patent
Schueler et al.

(10) Patent No.: US 9,717,940 B1
(45) Date of Patent: Aug. 1, 2017

(54) TRAMPOLINE SUSPENSION MOUNT AND CONNECTION SYSTEM

(71) Applicants: Luke Schueler, Coeur d'Alene, ID (US); Cody Schueler, Coeur d'Alene, ID (US)

(72) Inventors: Luke Schueler, Coeur d'Alene, ID (US); Cody Schueler, Coeur d'Alene, ID (US)

( * ) Notice: Subject to any disclaimer, the term of this patent is extended or adjusted under 35 U.S.C. 154(b) by 0 days.

(21) Appl. No.: 15/068,093

(22) Filed: Mar. 11, 2016

(51) Int. Cl.
*A63B 5/11* (2006.01)
*A63B 71/00* (2006.01)

(52) U.S. Cl.
CPC ..... *A63B 5/11* (2013.01); *A63B 71/0054* (2013.01); *A63B 2071/0063* (2013.01)

(58) Field of Classification Search
CPC .... A63B 5/11; A63B 5/00; A63B 5/08; A63B 71/0054; A63B 2071/0063; A63B 2005/058
USPC ..... 52/167.8, 167.1
See application file for complete search history.

(56) References Cited

U.S. PATENT DOCUMENTS

| | | | | |
|---|---|---|---|---|
| 896,213 | A | 8/1908 | Kerfoot | |
| 952,871 | A | 3/1910 | Browder | |
| 2,430,714 | A | 11/1947 | Geer | |
| 3,635,471 | A * | 1/1972 | Caron | A63B 5/11 482/29 |
| 3,677,368 | A | 7/1972 | Green | |
| 4,386,772 | A * | 6/1983 | Wu | A63B 5/11 482/28 |
| 5,336,135 | A | 8/1994 | Keyvani | |
| 6,598,365 | B2 | 7/2003 | Abraham et al. | |
| 6,648,799 | B2 * | 11/2003 | Hall | A63B 5/11 482/148 |
| 6,663,538 | B2 | 12/2003 | Yoon | |
| 6,733,420 | B1 | 5/2004 | Schroeder | |
| 6,939,270 | B2 * | 9/2005 | Wang | A63B 5/11 482/27 |
| 8,668,190 | B1 | 3/2014 | Heruska et al. | |
| 9,132,307 | B2 * | 9/2015 | Chen | A63B 5/11 |
| 2002/0098948 | A1 | 7/2002 | Yoon | |
| 2003/0070376 | A1 | 4/2003 | Abraham et al. | |
| 2006/0116242 | A1 | 6/2006 | Publicover | |
| 2008/0090704 | A1 | 4/2008 | Denis et al. | |

* cited by examiner

*Primary Examiner* — Loan H Thanh
*Assistant Examiner* — Megan Anderson
(74) *Attorney, Agent, or Firm* — Antoinette M. Tease

(57) ABSTRACT

A trampoline suspension mount and connection system with an elongated bedrail that is pivotally attached to a telescoping vertical stand. The telescoping vertical stand has a first tubular member, a second tubular member, and a base plate. The second tubular member fits telescopically inside of the first tubular member. A top end of the second tubular member is configured to form at least one channel into which an end of the bedrail is inserted. The first and second tubular members contain a shock absorber assembly.

8 Claims, 13 Drawing Sheets

TRAMPOLINE SUSPENSION MOUNT AND CONNECTION SYSTEM

BACKGROUND OF THE INVENTION

1. Field of the Invention

The present invention relates generally to the field of trampolines, and more specifically, to a trampoline suspension mount and connection system with a pivoting bedrail and a shock absorber assembly incorporated into the vertical stand.

2. Description of the Related Art

The trampoline park industry has grown rapidly in the United States in the past seven years and has recently expanded into international markets. One of the biggest problems the industry faces is injuries sustained by patrons when they land on trampoline pads. In a typical construction, a framework consisting of steel bars and/or steel cables underlies the trampoline pads, and springs connect the trampoline mat (jumping surface) to the trampoline bedrail (steel bar or steel cable). A thick vinyl foam pad is typically attached to the top of the bedrail to cover the underlying steel framework and springs. This foam pad is the only soft surface to protect the patron from injury when landing on the trampoline bedrail.

In a trampoline park utilizing steels cables in lieu of steel bars for the trampoline framework, the impact to the patron of landing on a bedrail is lessened to some degree by virtue of the limited flex afforded by the steel cables; however, the amount of flex provided by the steel cables is limited and poses its own problems. In particular, the impact of the patron contacting with the steel cables is not primarily absorbed (there is a small amount of energy absorption) but rather transferred throughout the cables of the interconnected trampolines, creating a wave effect among all of the steel cables throughout the court and reducing their effectiveness in absorbing energy upon impact. Trampoline parks with steel bars undergirding the trampolines provide no energy absorption upon impact whatsoever, thereby posing a risk of serious injury.

The present invention solves the problem of injuries sustained as a result of landing on trampoline pads/bedrails by incorporating a shock absorption assembly into the trampoline framework. This system allows the bedrails to pivot upon impact, thereby lessening the force of the impact on the patron. There have been a number of patent filings related to trampolines and trampoline structures, but none of these inventions incorporates the safety features of the present invention.

U.S. Pat. No. 3,677,368 (Green, 1972) discloses a trampoline with a frame made of tubular material and supported on legs that resist downward movement of the frame in response to the exertion of a downward impact on the frame. The invention also includes "yieldingly supported" pad means on the frame to cushion the impact of the user on the frame.

U.S. Pat. No. 5,336,135 (Keyvani, 1993) provides an amusement apparatus comprised of a series of trampolines arranged vertically and offset to allow a user to jump serially from the uppermost trampolines to the lower trampolines. In one embodiment, a trampoline has a rigid support structure except for a portion that is deflectable when excess force is applied to the trampoline. The latter embodiment incorporates a curved "flexure bar" terminating in a steel spring to absorb partially the force of impact.

U.S. Pat. No. 6,598,365 (Abraham et al., 2003) describes an impact- and energy-absorbing product for floors, walls and other flat surfaces. The invention essentially involves placing coiled springs throughout the area to be protected. Flared inserts are attached to the springs, and these flared inserts are inserted into a receiving member, which is affixed to a flat surface.

U.S. Pat. No. 6,663,538 (Yoon, 2003) involves a so-called "safety" trampoline comprised of a generally circular inner canvas with a plurality of inner plane springs distributed around its perimeter and a generally circular outer canvas with a plurality of outer plane springs distributed around its perimeter. Binding ropes attach the inner plane springs to the inner canvas and the outer plane springs to the outer canvas.

U.S. Pat. No. 6,733,420 (Schroeder, 2004) discloses an exercise apparatus comprised of a frame formed by angular elements joined at their adjacent corners, which include shoulders and gussets, and a bed of fabric disposed within the frame and joined to the frame with coiled springs. A plunger in the leg assemblies provides additional stroke displacement during use of the apparatus.

U.S. Pat. No. 8,668,190 (Heruska et al., 2014) provides an impact-absorbing structure with a vertical hollow column that telescopically receives a post. A coil spring is situated between a support plate at the top of the vertical hollow column and a top plate that is connected to the top end of the post. The post retracts within the hollow column and the spring is compressed when downward force is applied to the top plate.

U.S. Patent Application Pub. No. 2006/0116242 (Publicover) describes a trampoline with adjustable spring tension in which springs or other elastic connectors support a bed within the trampoline frame and are adjustably connected to one another. The tension between the springs can be adjusted to provide for more or less tension between adjacent (or sets of adjacent) springs.

BRIEF SUMMARY OF THE INVENTION

The present invention is a trampoline suspension mount and connection system, comprising: an elongated bedrail that is pivotally attached to a telescoping vertical stand, the telescoping vertical stand comprising a first tubular member, a second tubular member, and a base plate, wherein the first tubular member is hollow and is attached to and extends upward from the base plate, and wherein the second tubular member fits telescopically inside of the first tubular member; wherein a top end of the second tubular member is configured to form at least one channel into which a first end of the bedrail is inserted, the first end of the bedrail comprising a shaft about which the first end of the bedrail rotates in relation to the top end of the second tubular member; and wherein the first and second tubular members contain a shock absorber assembly, the shock absorber assembly comprising a cylindrical bottom post that is secured on a bottom end of the cylindrical bottom post to a base plate that is configured to fit inside of the first tubular member, wherein a bottom end of a shock absorber is attached to a top end of the cylindrical bottom post, and wherein a top part of the shock absorber is attached to the top end of the second tubular member.

In a preferred embodiment, the second tubular member comprises four outside surfaces and four plastic liners, each of which is affixed to an outside surface of the second tubular member. Preferably, the bedrail comprises means for attaching trampoline springs. The means for attaching trampoline springs is preferably one or more zigzag-shaped members.

In a preferred embodiment, the first end of the bedrail comprises a cylindrical bushing that is situated within a cylindrical channel in the first end of the bedrail, and the shaft passes through a central hole in the cylindrical bushing. Preferably, the shock absorber assembly further comprises a coil spring that is situated around the cylindrical bottom post between the base plate and a top plate, the top plate being situated at a top end of the cylindrical bottom post. The shock absorber is preferably a gas spring.

In a preferred embodiment, the shaft extends through a slot in each of two plates on either side of the first end of the bedrail, and the slot is configured so as to allow the shaft to move laterally within the slots as the bedrail pivots.

REFERENCE NUMBERS

Figure 1:
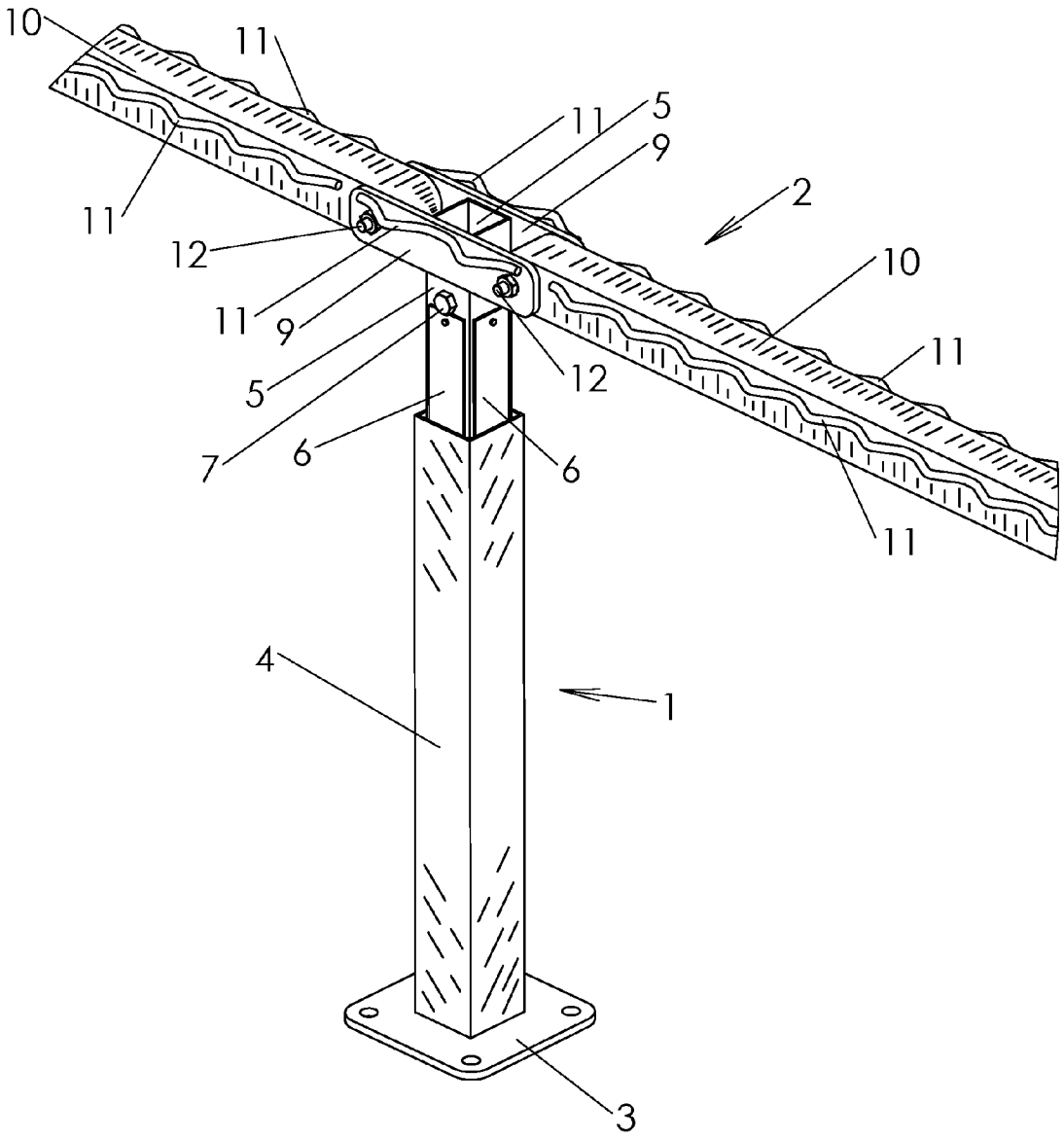
FIG. 1 is a perspective view of the trampoline suspension mount and connection system of the present invention.

1 Vertical stand
2 Horizontal bedrail assembly
3 Base plate
4 First tubular member
5 Second tubular member
6 Plastic liner
7 Bolt
8 Shock absorber
9 Receiving bracket
**9*a*** Support plate
**9*b*** Receiving plate
**9*c*** Arcuate member
10 Bedrail
**10*a*** Cylindrical channel
11 Zigzag member
12 Bolt
**12*a* Hole (for bolt 12**)
13 Slot (in receiving bracket)
14 Shock absorber assembly
15 Bottom post
16 Base plate
17 Pin
18 Spring stop collar
19 Coil spring
20 Top plate
21 Support bracket
22 Trampoline mat
23 Trampoline springs
24 Bushing

DETAILED DESCRIPTION OF INVENTION

FIG. 1 is a perspective view of the trampoline suspension mount and connection system of the present invention. As shown in this figure, the invention comprises a vertical stand 1 and a horizontal bedrail assembly 2. The vertical stand 1 comprises a base plate 3, a first tubular member 4 (hollow) attached to and extending upward from the base plate 3, and a second tubular member 5 (hollow) that fits telescopically inside of the first tubular member 4. The outside diameter of the second tubular member 5 is less than the inside diameter of the first tubular member 4, and the second tubular member 5 preferably comprises four flat plastic (preferably polytetrafluoroethylene or TEFLON liners 6, each of which is attached to one of the four outside surfaces of the second tubular member 5. Both the first and second tubular member 4, 5 are elongated. The plastic liners 6 preferably extend from the top of the second tubular member 5 just underneath the bolt 7 that secures the shock absorber 8 (not shown) to the second tubular member 5 all the way to the bottom of the second tubular member 5 (see FIG. 3). Note that the top end of the first tubular member 4 is open (so that the second tubular member 5 can slide into it), and the bottom end of the first tubular member 4 is closed (because it is welded to the base plate 3. Both the top and bottom ends of the second tubular member 5 are preferably open.

Welded to the top end of the second tubular member 5 are two elongated receiving brackets 9. Each receiving bracket 9 is oriented horizontally and is perpendicular to the central axis of the first and second tubular member 4, 5. In this embodiment, each receiving bracket 9 is welded to an outside face of the second tubular member 5, and the receiving brackets 9 are situated on opposing surfaces of the second tubular member 5. The height of the receiving bracket 9 is preferably the same as the height of the bedrail 10, and the width of the receiving bracket 9 is preferably equal to at least three times the width of the second tubular member 5. The receiving bracket 9 is preferably centered on the top end of the second tubular member 5.

In a preferred embodiment, the receiving bracket 9 comprises a zigzag-shaped member 11 that is welded to the outside of the receiving bracket 9 and that serves as an attachment point for trampoline springs (not shown). A bedrail 10 is pivotally attached to the receiving brackets 9 on each end of the receiving brackets 9. As shown in FIG. 1, one end of the bedrail 10 fits between two opposing ends of the two receiving brackets 9 and is secured to the receiving brackets 9 with a bolt 12 that extends through both receiving brackets 9 and the intervening end of the bedrail 9. In a preferred embodiment, a zigzag-shaped member 11 is welded to the two horizontally-facing outer surfaces of each of the bedrails 9; these zigzag-shaped members 11 serve as attachment points for the trampoline springs (not shown). Note that the height of the bedrail 10 is preferably approximately the same as the height of the receiving bracket 9, and the width of the bedrail 10 is approximately equal to the distance between the inner surfaces of the opposing receiving brackets 9. Note also that the top end of the second tubular member 5 preferably terminates just slightly below the top edge of the receiving bracket 9.

Figure 2:
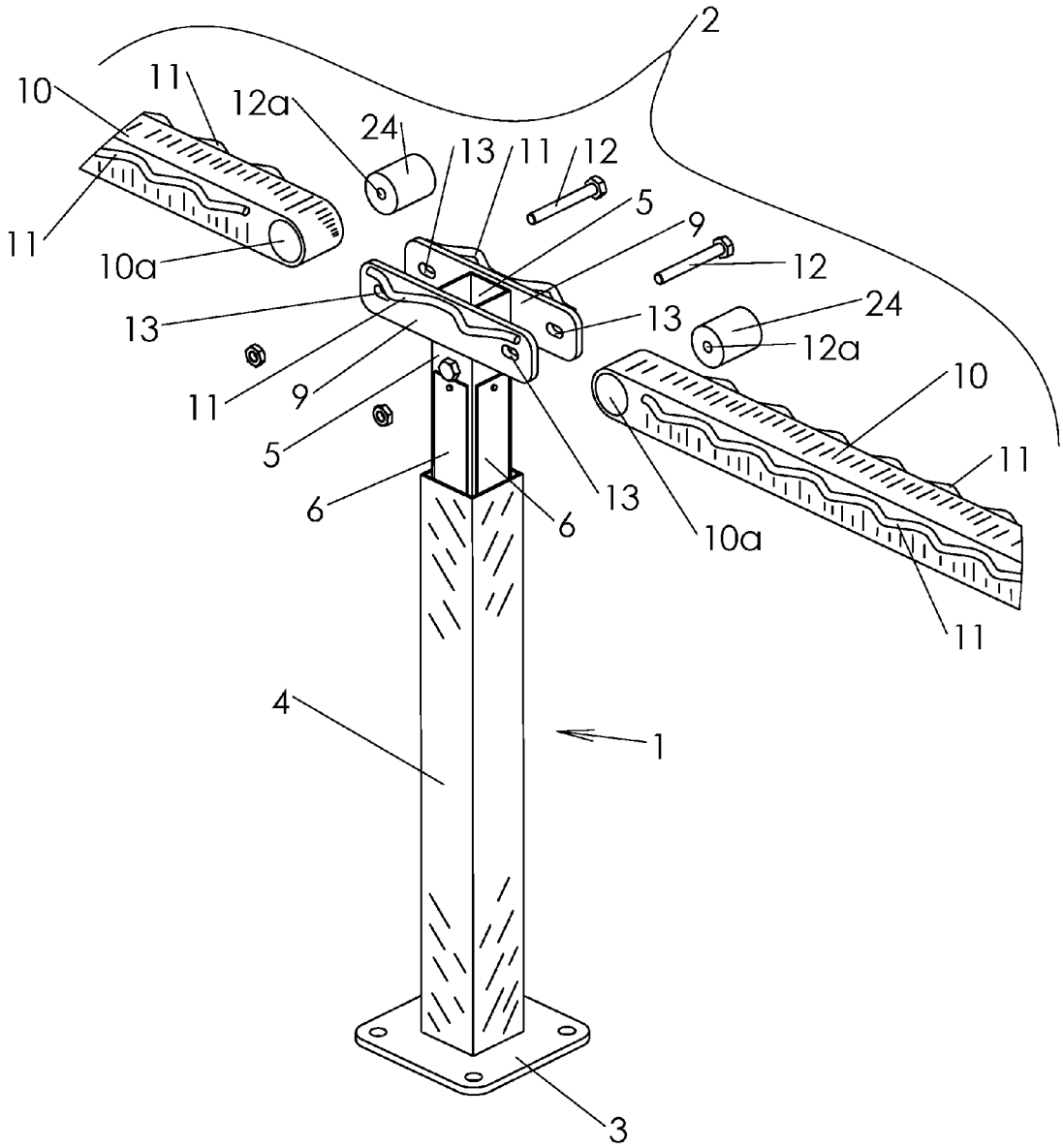
FIG. 2 is an exploded view of the bedrail attachment point of the present invention.

FIG. 2 is an exploded view of the bedrail attachment point of the present invention. As shown in this figure, the bolts 12 that extend through the receiving brackets 9 and bedrails 10 pass through horizontal slots 13 located on each end of the receiving brackets 9. These slots 13 are preferably elongated in that the width of the slot is greater than the height of the slot, for reasons that are explained below in connection with FIGS. 4 and 5. In a preferred embodiment, a cylindrical bushing 24 is situated within a cylindrical channel 10*a* in the end of the bedrail 10 that is inserted into the channel between the two receiving brackets 9. Each bolt 12 extends through the slots 13 in the receiving brackets 9 and also through a central hole 12*a* in the bushing 24. Note that the bolt 12 acts as a shaft about which the end of the bedrail 10 rotates.

Figure 3:
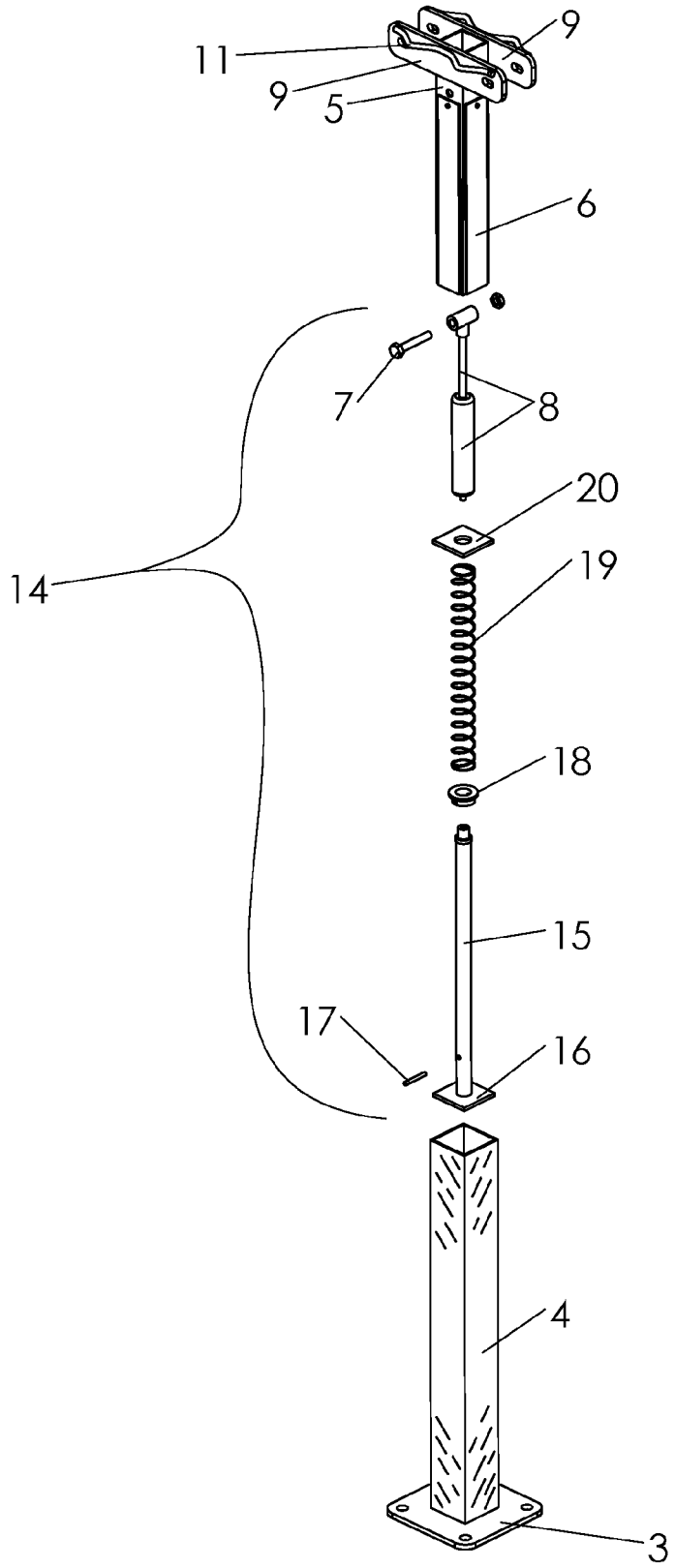
FIG. 3 is an exploded view of the shock absorber assembly of the present invention.

FIG. 3 is an exploded view of the shock absorber assembly of the present invention. As shown in this figure, the shock absorber assembly 14 comprises a cylindrical bottom post 15 that is secured on one end to a base plate 16 that is configured to fit inside of the first tubular member 4. A pin 17 secures the bottom end of the cylindrical bottom post 15 to a spring stop collar 18 that extends around the cylindrical bottom post 15 and sits on top of the base plate 16. An optional coil spring 19 is situated around the cylindrical bottom post 15 between the base plate 16 and a top plate 20; the top plate 20 abuts up against the bottom surface of the second tubular member 5. The bottom end of a shock absorber 8, preferably in the form of a gas spring, screws into the top end of the cylindrical bottom post 15. As noted in connection with FIG. 1, the top part of the gas spring 8 is secured to the top end of the second tubular member 5 (directly underneath the receiving bracket 9) with a bolt 7. The shock absorber 8 is situated inside of the second tubular member 5 between the top plate 20 and the top end of the second tubular member 5. In the embodiment without the coil spring 19, there would not necessarily need to be a top plate 20 or a spring stop collar 18.

Figure 4:
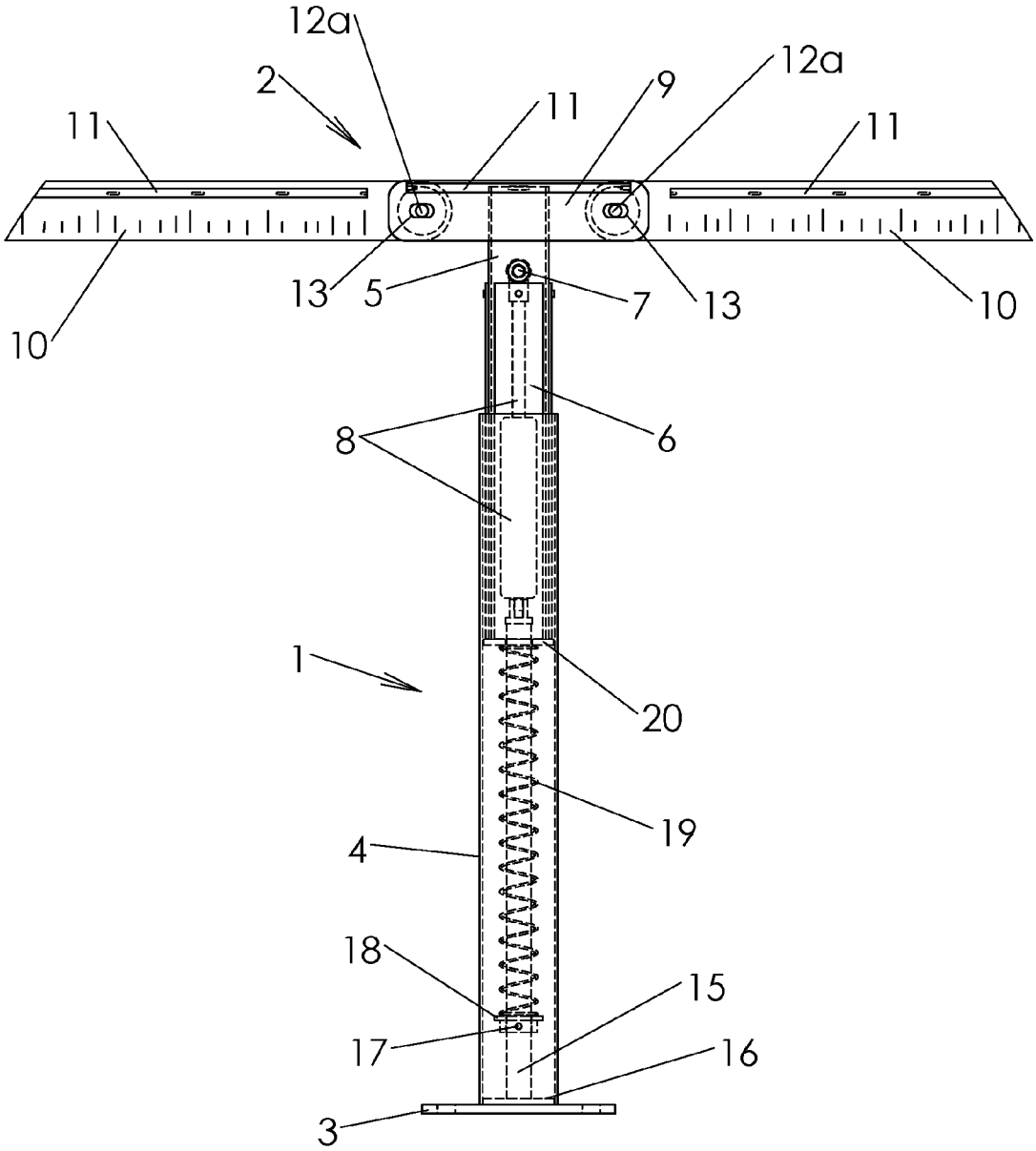
FIG. 4 is a section view of the trampoline suspension mount and connection system of the present invention shown with the shock absorber in an uncompressed position.
Figure 5:
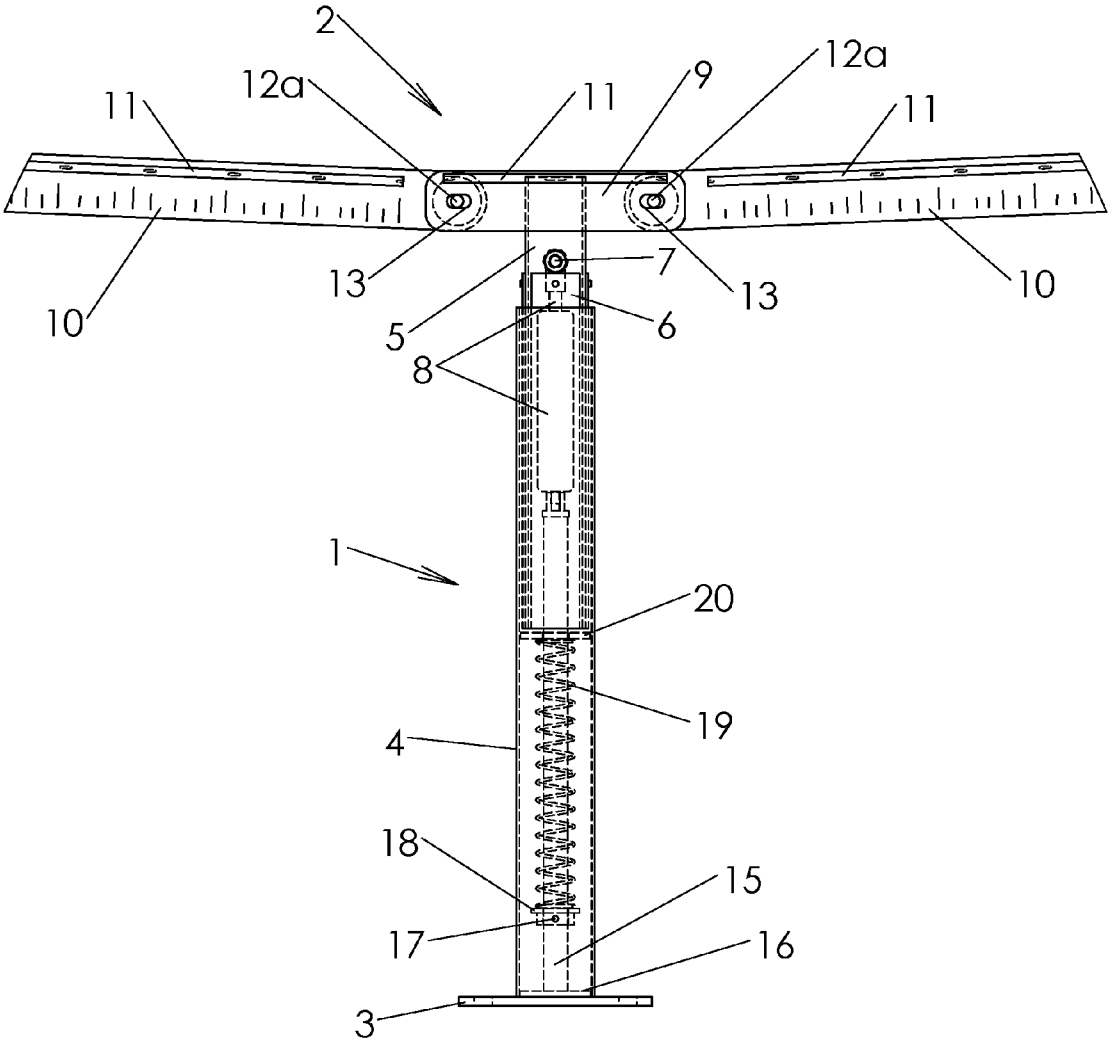
FIG. 5 is a section view of the trampoline suspension mount and connection system of the present invention shown with the shock absorber in a compressed position.

FIG. 4 is a section view of the trampoline suspension mount and connection system of the present invention shown with the shock absorber in an uncompressed position, and FIG. 5 is a section view of the trampoline suspension mount and connection system of the present invention shown with the shock absorber in a compressed position. As shown in FIG. 4, when no weight is placed upon the bedrail 10, the shock absorber 8 is fully extended, and the bedrail 10 remains horizontal (that is, perpendicular to the first and second tubular member 4, 5); however, as shown in FIG. 5, when downward force is applied to the bedrail 10, the bedrail 10 pivots in relation to the vertical stand 1 such that the bedrail 10 moves (or pivots) downward at the receiving bracket 9 as the shock absorber 8 retracts.

Figure 18:
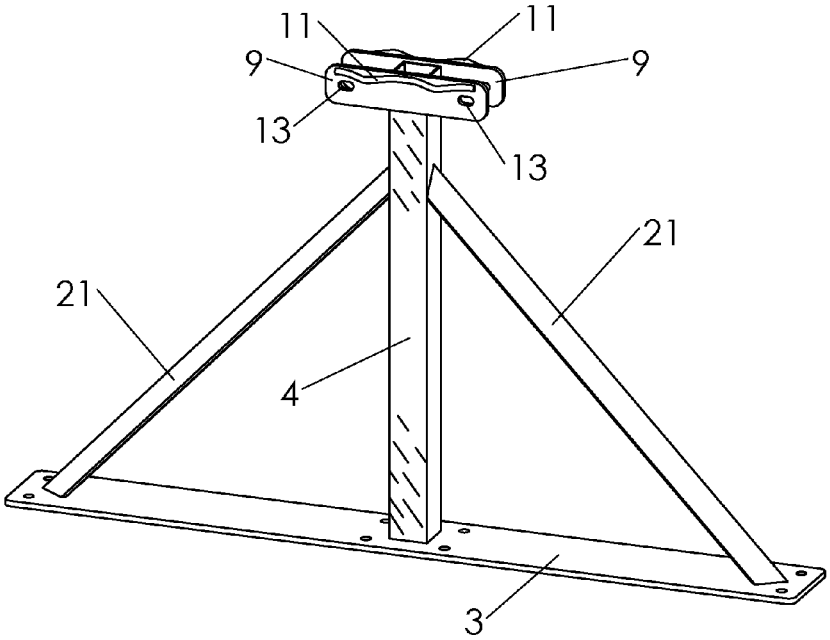
FIG. 18 is a perspective view of a stationary vertical stand without a shock absorber assembly.

Note that the other end of the bedrail 10 (not shown) may be connected to another vertical stand with a shock absorber, or it may be connected to a vertical stand without a shock absorber (see FIG. 18). If both ends of the bedrail are connected to a vertical stand with a shock absorber, then the entire bedrail will move downward to some degree, and the end of the bedrail that is connected (via the receiving bracket) to the top of the vertical stand will pivot (relative to the receiving bracket) to some degree, as shown in FIG. 4. If, on the other hand, the other end of the bedrail is connected to a vertical stand without a shock absorber, then the end of the bedrail that is connected (via the receiving bracket) to the top of the vertical stand will move downward (or pivot relative to the receiving bracket) to a greater degree than that shown in FIG. 4; in other words, the bedrail will appear to be at a greater angle relative to the second tubular member than that shown in FIG. 4 because the end of the bedrail that is situated over the shock absorber will move downward by a distance equal to the degree of retraction of the shock absorber.

Note also the relative positions of the bolts 12 (not shown) in the slots 13 in the receiving brackets 9 in FIGS. 4 and 5. In the position shown in FIG. 4 (no weight on bedrail), the bolts 12 are situated in that end of the slot 13 that is closest to the vertical stand 1. In the position shown in FIG. 5 (weight on bedrail), the bolts 12 have moved outward within the slots 13. In a preferred embodiment, the slots 13 are configured so as to allow the bolts 12 to move laterally within the slots 13 as the bedrail pivots. As the second tubular member 5 travels down under the load, the second tubular member 5 pushes the top plate 20 down, thereby compressing the coil spring 19 between the spring stop collar 18 and the top plate 20. When weight is lifted, the coil spring 19 pushes the top plate 20 and second tubular member 5 upward, thereby assisting the shock absorber/gas spring 8 in lifting the entire assembly 2 upward. In FIGS. 4 and 5, the bolts 12 have been omitted for clarity, but the holes 12*a* in the bushing 24 (in the end of the bedrail 10) through which the bolts extend are labeled.

Figure 6:
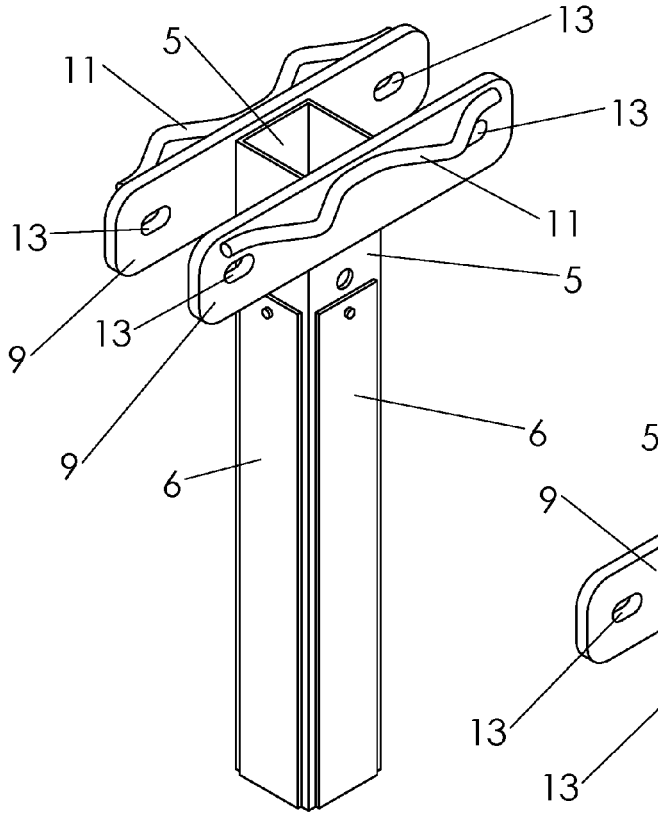
FIG. 6 is a perspective view of a first embodiment of the top part of the vertical stand of the present invention.
Figure 7:
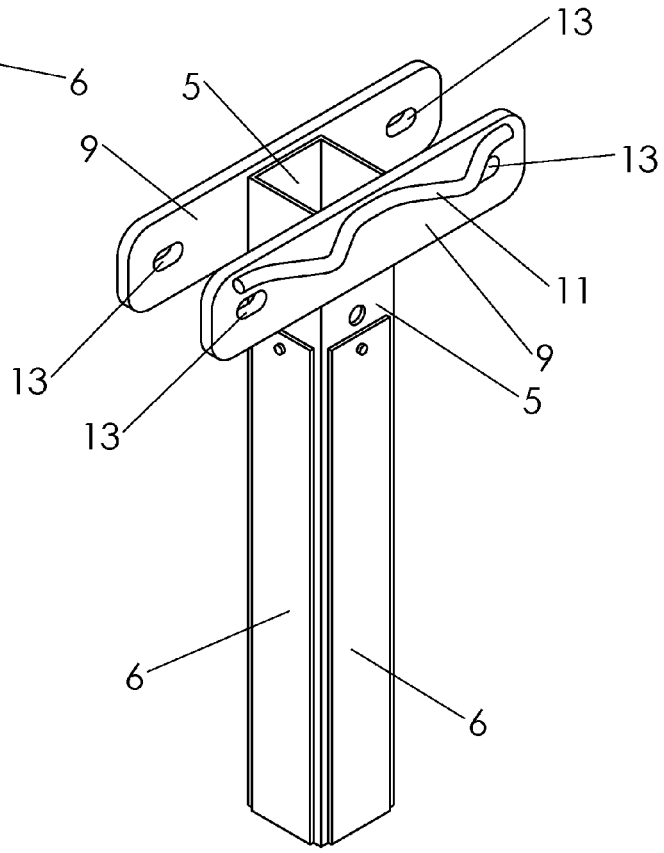
FIG. 7 is a perspective view of a first embodiment of the top part of the vertical stand of the present invention
Figure 8:
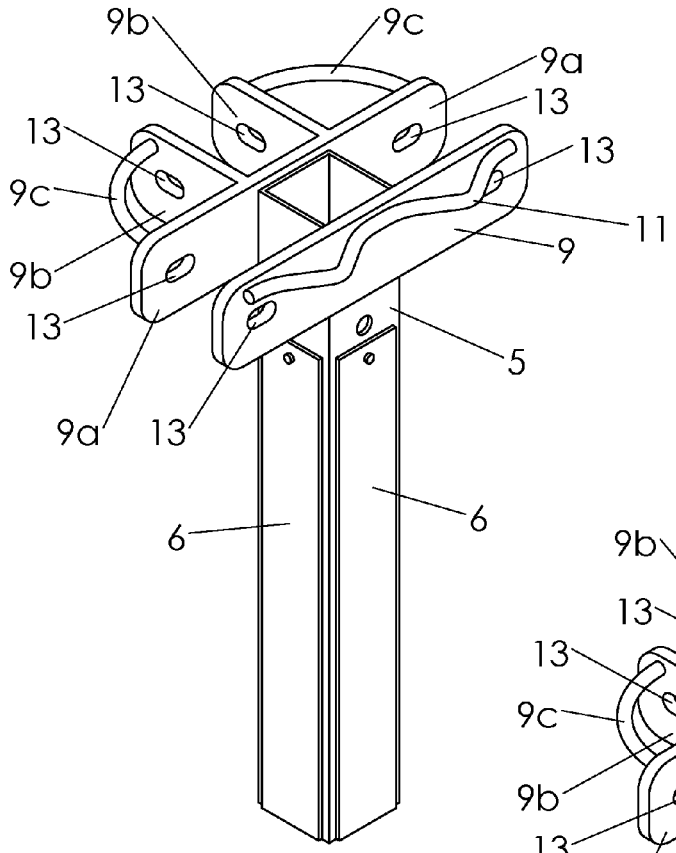
FIG. 8 is a perspective view of a second embodiment of the top part of the vertical stand of the present invention.
Figure 9:
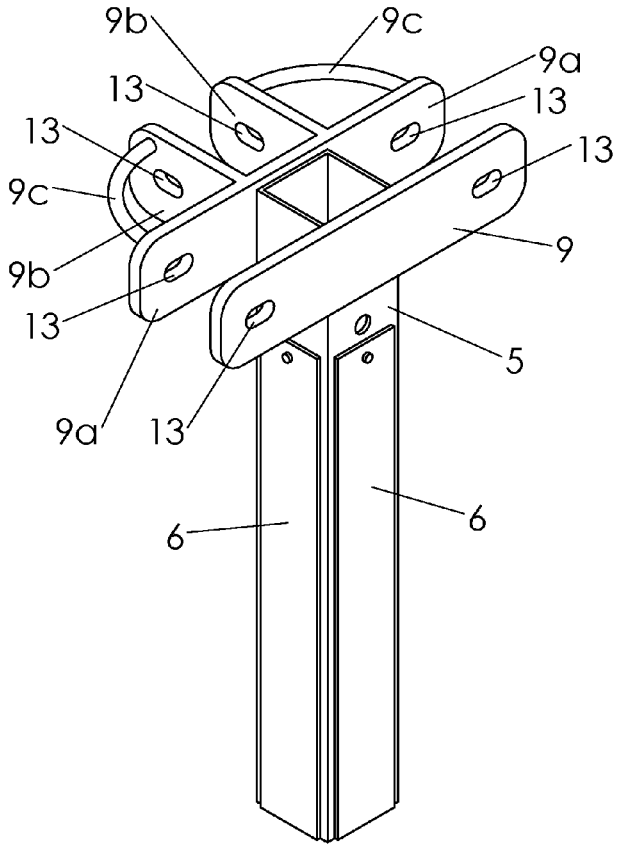
FIG. 9 is a perspective view of a third embodiment of the top part of the vertical stand of the present invention.

FIG. 6-10 show alternate embodiments of the receiving brackets 9. FIG. 6 shows the same receiving bracket configuration as shown in the previous figures. FIG. 7 shows the same receiving bracket configuration as in FIG. 6 except that the zigzag members 11 have been omitted from one of the receiving brackets. FIG. 8 shows a receiving bracket configuration in which one of the receiving brackets is the same as shown in FIG. 6, and the other receiving bracket is comprised of a support plate 9*a* (similar to the receiving bracket 9 described in connection with the previous figures) and two shorter receiving plates 9*b* that are parallel to one another and extend outwardly from the support plate 9*a* at a ninety (90)-degree angle. Each of the two receiving plates 9*b* comprises a slot 13 as previously described, and the support plate 9*a* comprises a slot 13 on either end of the support plate. Two bedrails 10 (not shown) are inserted between the receiving bracket 9 and support plate 9*a* and secured therein by bolts (not shown) that allow the bedrails to pivot in relation to the receiving bracket/support plate, as previously described. One bedrail 10 (not shown) is inserted into the recess between the two receiving plates 9*b* and secured therein by a bolt (not shown) that allows the bedrail to pivot in relation to the receiving plates 9*b*. Thus, the vertical stand configuration shown in FIG. 8 can accommodate three bedrails as opposed to two. The embodiment shown in FIG. 9 differs from the embodiment shown in FIG. 8 only in that the zigzag members have been omitted from the one receiving bracket 9. Arcuate members 9*c* between the receiving plates 9*b* and the support plate 9*a* provide additional structural support.

Figure 10:
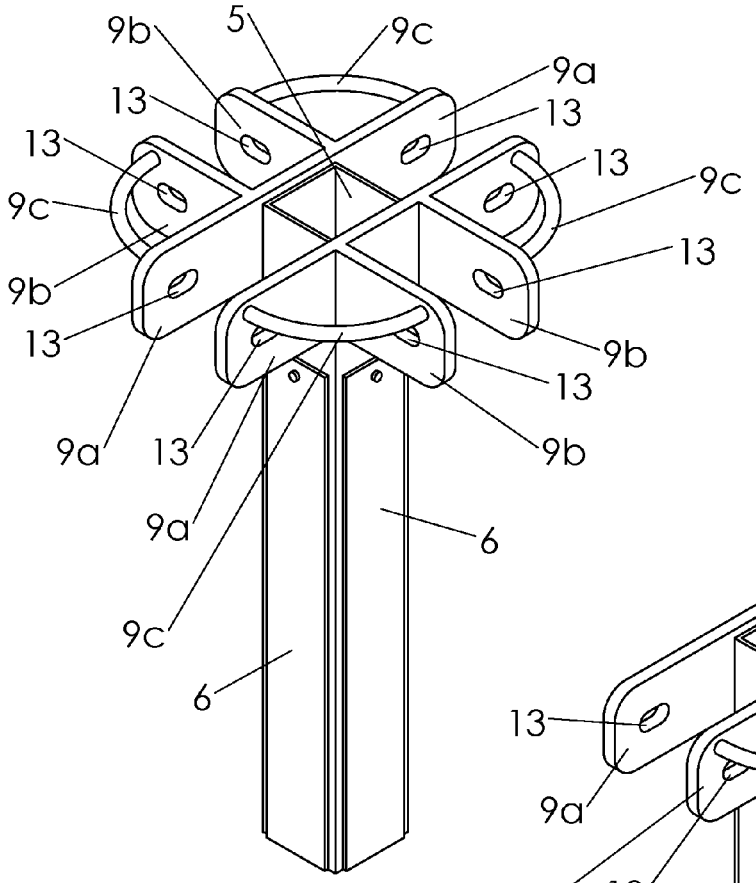
FIG. 10 is a perspective view of a fourth embodiment of the top part of the vertical stand of the present invention.
Figure 11:
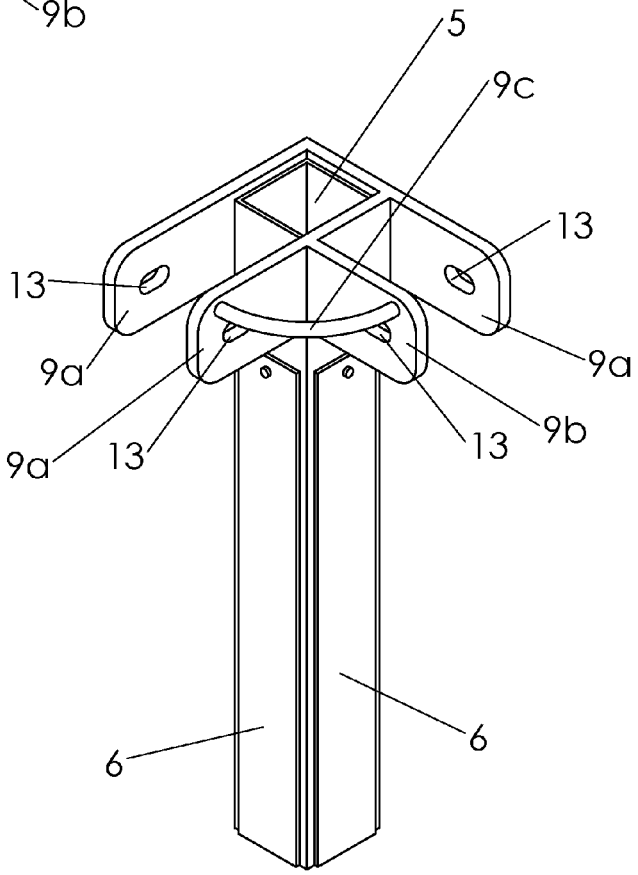
FIG. 11 is a perspective view of a fifth embodiment of the top part of the vertical stand of the present invention.
Figure 12:
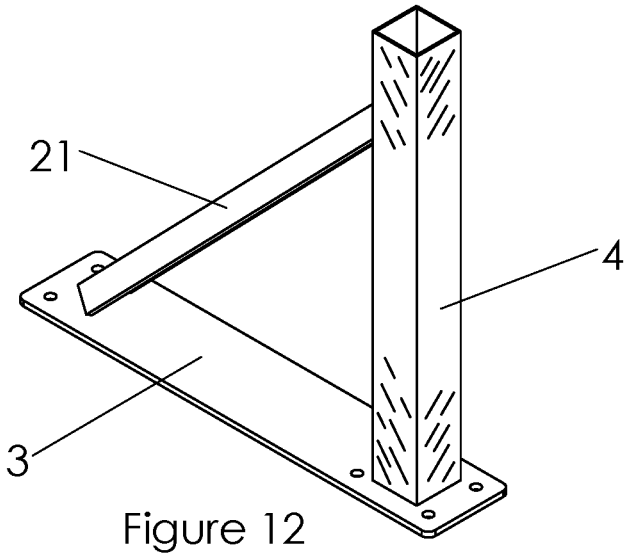
FIG. 12 is a perspective view of a first embodiment of the bottom part of the vertical stand of the present invention.
Figure 13:
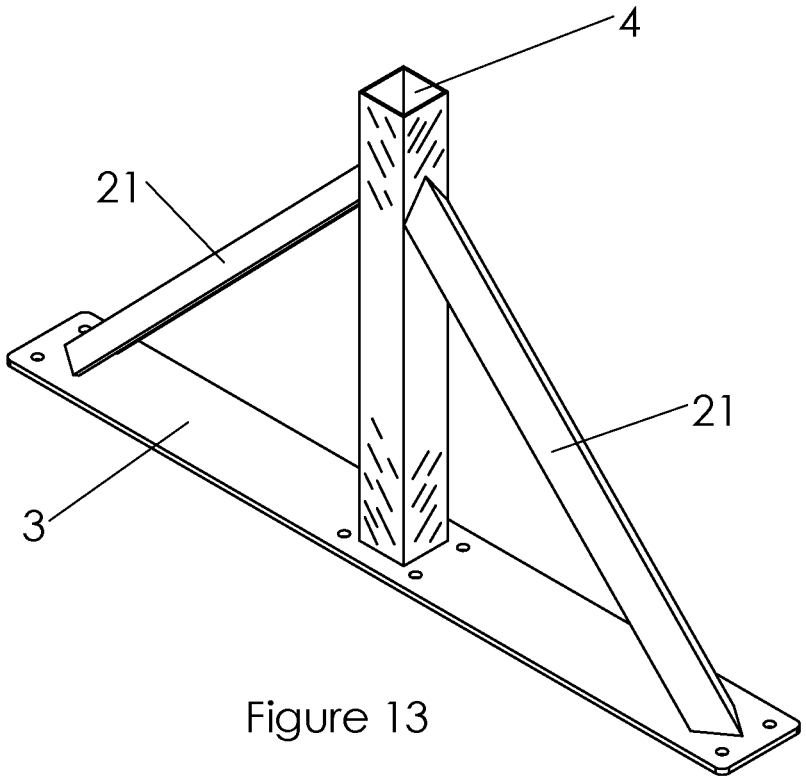
FIG. 13 is a perspective view of a second embodiment of the bottom part of the vertical stand of the present invention.
Figure 14:
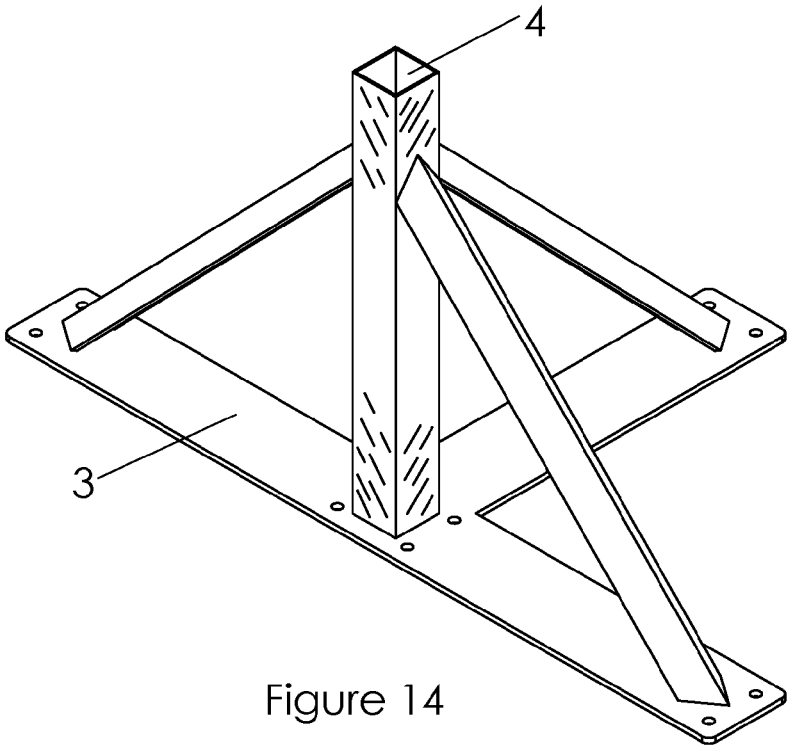
FIG. 14 is a perspective view of a third embodiment of the bottom part of the vertical stand of the present invention.
Figure 15:
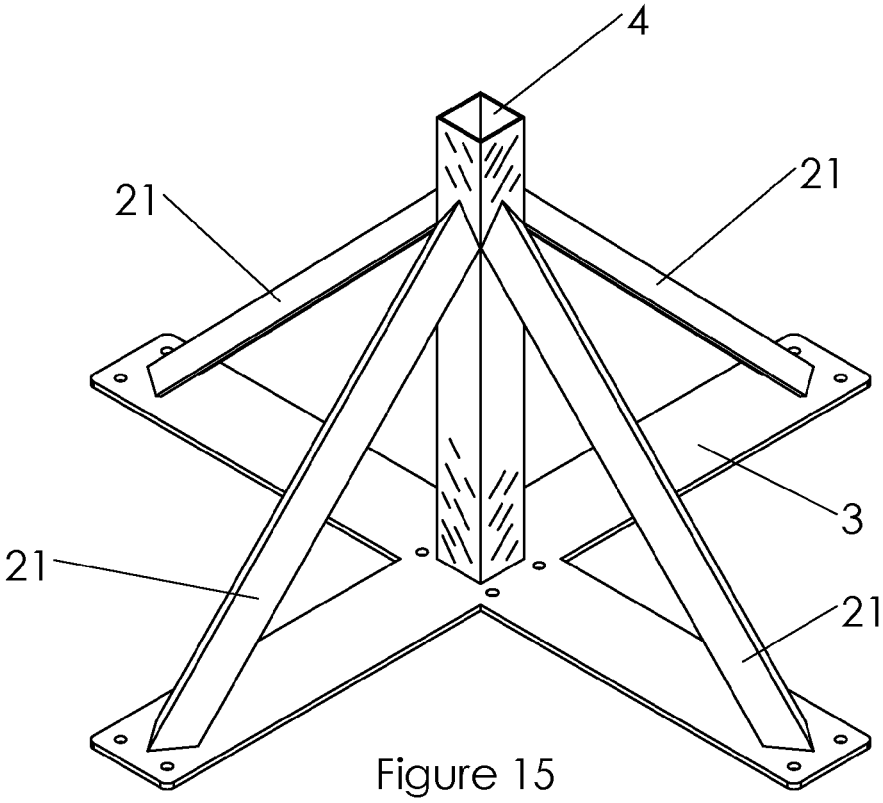
FIG. 15 is a perspective view of a fourth embodiment of the bottom part of the vertical stand of the present invention.
Figure 16:
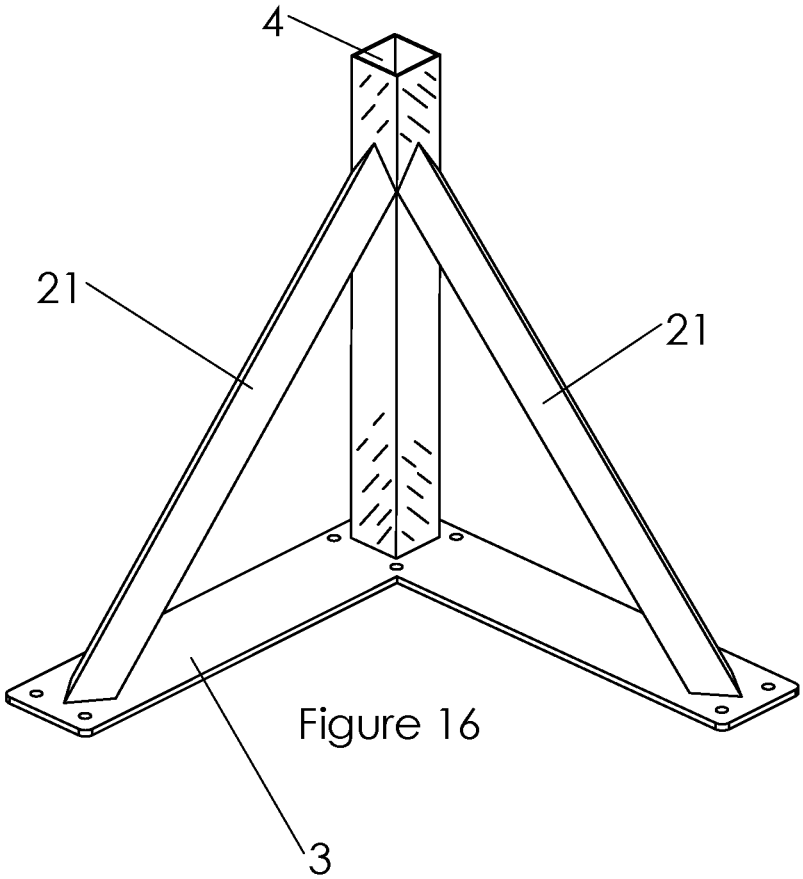
FIG. 16 is a perspective view of a fifth embodiment of the bottom part of the vertical stand of the present invention.
Figure 17:
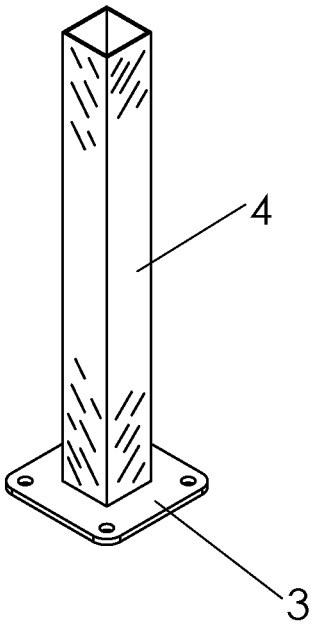
FIG. 17 is a perspective view of a sixth embodiment of the bottom part of the vertical stand of the present invention.

The embodiment shown in FIG. 10 is comprised of two support plates 9*a* and four receiving plates 9*b*. This particular configuration can accommodate four pivoting bedrails. The embodiment shown in FIG. 11 is comprised of three truncated support plates 9*a* and one receiving plate 9*b*; this embodiment can accommodate two bedrails 10 oriented perpendicularly to one another.

FIGS. 12-17 illustrate alternate embodiments of the bottom part of the vertical stand. The first tubular member 4 is the same in all of these embodiments. As indicated, the base plate 3 may take any one of the different forms shown in these figures (or any other form); the present invention is not limited to any particular size or shape of the base plate 3. The first tubular member 4 may be further supported by one or more diagonal support brackets 21. The support brackets 21 are welded on one end to the first tubular support member 4 and one another end to the base plate 3.

FIG. 18 is a perspective view of a stationary vertical stand without a shock absorber assembly. As noted above, it may be preferable in some configurations of the trampoline park to attach one end of the bedrail to the vertical stand with the shock absorber shown in FIG. 1 and another end of the bedrail to a vertical stand without the shock absorber. In the vertical stand shown in this figure, there is no second tubular member (see reference number 5 in FIG. 1); there is only a first tubular member 4, the top end of which is welded to the inside surfaces of the two parallel receiving brackets 9. In this embodiment, the outer diameter of the first tubular member 4 is the same as the outer diameter of the second tubular member 5 shown in previous embodiments because the top end of the tubular member must have roughly the same outer diameter as the bedrail in order to fit within the channel created by the receiving brackets 9, support plates 9*a* and/or receiving plates 9*c*.

Figure 19:
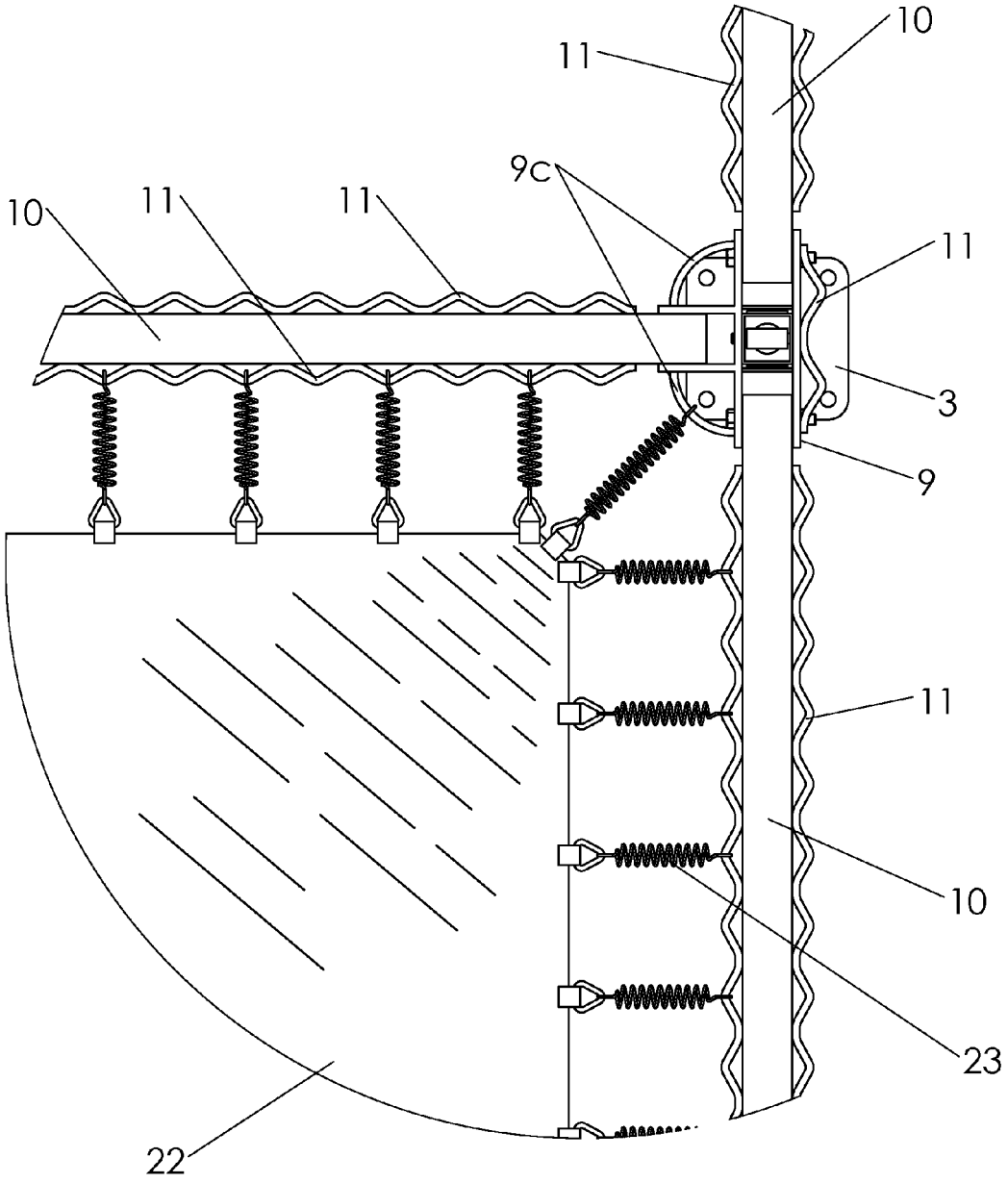
FIG. 19 is a top detail view of a trampoline mat connected to the trampoline suspension mount and connection system of the present invention.

FIG. 19 is a top detail view of a trampoline mat connected to the trampoline suspension mount and connection system of the present invention. As shown in this figure, when fully assembled, the trampoline mat 22 is connected to the zigzag members 11 and/or the arcuate members 9*c* with trampoline springs 23. A foam pad (not shown) is then placed over the trampoline mat 22 and interconnected bedrail framework.

Although the preferred embodiment of the present invention has been shown and described, it will be apparent to those skilled in the art that many changes and modifications may be made without departing from the invention in its broader aspects. The appended claims are therefore intended to cover all such changes and modifications as fall within the true spirit and scope of the invention.

We claim:

1. A trampoline suspension mount and connection system, comprising:

an elongated bedrail that is pivotally attached to a telescoping vertical stand, the telescoping vertical stand comprising a first tubular member, a second tubular member, and a base plate, wherein the first tubular member is hollow and is attached to and extends upward from the base plate, and wherein the second tubular member fits telescopically inside of the first tubular member;

wherein a top end of the second tubular member is configured to form a channel into which a first end of the elongated bedrail is inserted, the first end of the elongated bedrail comprising a shaft about which the first end of the elongated bedrail rotates in relation to the top end of the second tubular member; and wherein the first and second tubular members contain a shock absorber assembly, the shock absorber assembly comprising a cylindrical bottom post that is secured on a bottom end of the cylindrical bottom post to a second base plate that is configured to fit inside of the first tubular member, wherein a bottom end of a shock absorber is attached to a top end of the cylindrical bottom post, and wherein a top part of the shock absorber is attached to the top end of the second tubular member.

2. The trampoline suspension mount and connection system of claim 1, wherein the elongated bedrail comprises means for attaching trampoline springs.

3. The trampoline suspension mount and connection system of claim 2, wherein the means for attaching trampoline springs is one or more zigzag-shaped members.

4. The trampoline suspension mount and connection system of claim 1, wherein the second tubular member comprises four outside surfaces and four plastic liners, each of which is affixed to an outside surface of the second tubular member.

5. The trampoline suspension mount and connection system of claim 1, wherein the first end of the elongated bedrail comprises a cylindrical bushing that is situated within a cylindrical channel in the first end of the elongated bedrail, and wherein the shaft passes through a central hole in the cylindrical bushing.

6. The trampoline suspension mount and connection system of claim 1, wherein the shock absorber assembly further comprises a coil spring that is situated around the cylindrical bottom post between the second base plate and a top plate, the top plate being situated at a top end of the cylindrical bottom post.

7. The trampoline suspension mount and connection system of claim 1, wherein the shock absorber is a gas spring.

8. The trampoline suspension mount and connection system of claim 1, wherein the shaft extends through a slot in each of two plates on either side of the first end of the elongated bedrail, and wherein the slot is configured so as to allow the shaft to move laterally within the slots as the elongated bedrail pivots.

* * * * *